US008316543B2

(12) United States Patent
Patzelt et al.

(10) Patent No.: US 8,316,543 B2
(45) Date of Patent: Nov. 27, 2012

(54) METHOD FOR RECONDITIONING A USED GRINDING ROLLER

(75) Inventors: Norbert Patzelt, Beckum (DE); Johann Knecht, Wadersloh (DE); Herbert Pingel, Wadersloh (DE)

(73) Assignee: Polysius AG, Beckum (DE)

( * ) Notice: Subject to any disclaimer, the term of this patent is extended or adjusted under 35 U.S.C. 154(b) by 539 days.

(21) Appl. No.: 12/529,692

(22) PCT Filed: Dec. 19, 2007

(86) PCT No.: PCT/EP2007/064203

§ 371 (c)(1),
(2), (4) Date: Sep. 2, 2009

(87) PCT Pub. No.: WO2008/110224

PCT Pub. Date: Sep. 18, 2008

(65) Prior Publication Data

US 2010/0058570 A1 Mar. 11, 2010

(30) Foreign Application Priority Data

Mar. 13, 2007 (DE) ..... 10 2007 012 102

(51) Int. Cl.
*D21B 1/14* (2006.01)
*B02C 4/02* (2006.01)

(52) U.S. Cl. ..... 29/895.31; 29/895.1; 29/402.04; 492/36

(58) Field of Classification Search ..... 29/895.1, 29/895.31, 402.03, 402.04, 402.18, 402.21, 29/102.13, 402.16, 402.164; 492/28, 30, 492/36

See application file for complete search history.

(56) References Cited

U.S. PATENT DOCUMENTS

| | | | | | |
|---|---|---|---|---|---|
| 412,558 | A | * | 10/1889 | Stephens | 241/294 |
| 1,340,032 | A | * | 5/1920 | Fleming | 228/119 |
| 1,884,104 | A | * | 10/1932 | Moore et al. | 29/895.1 |
| 2,195,256 | A | * | 3/1940 | Palmer | 228/119 |
| 2,817,218 | A | * | 12/1957 | Beckwith | 62/45.1 |
| 3,004,336 | A | * | 10/1961 | Timuska | 29/888.041 |
| 3,006,064 | A | * | 10/1961 | Watson | 29/402.13 |
| 3,006,065 | A | * | 10/1961 | Watson | 228/119 |
| 3,007,231 | A | * | 11/1961 | Garver | 29/895.211 |
| 3,168,767 | A | * | 2/1965 | Lutz | 164/92.1 |
| 3,227,008 | A | * | 1/1966 | Celovsky | 76/101.1 |
| 3,412,946 | A | * | 11/1968 | Gabler et al. | 241/293 |
| 4,322,596 | A | * | 3/1982 | Krakow et al. | 219/73.21 |
| 4,404,450 | A | * | 9/1983 | Weldon | 219/76.12 |
| 4,748,736 | A | * | 6/1988 | Miihkinen | 29/527.2 |

(Continued)

FOREIGN PATENT DOCUMENTS

CA 2202213 A1 * 4/1997

(Continued)

*Primary Examiner* — David Bryant
*Assistant Examiner* — Jason L Vaughan
(74) *Attorney, Agent, or Firm* — Gifford, Krass, Sprinkle, Anderson & Citkowski, P.C.

(57) ABSTRACT

The invention relates to a method for reconditioning a used grinding roller of a material bed roller mill having profile-members which are embedded, with a portion of the length thereof, in holes of the roller body and, with the remainder of the length thereof, project above the surface of the roller body. For the reconditioning operation, after the worn profile-members are removed, the worn surface of the roller body is turned, and a material layer is applied in a welding operation and is provided with holes for receiving new profile-members. Such a method allows particularly cost-effective reconditioning.

11 Claims, 3 Drawing Sheets

U.S. PATENT DOCUMENTS

| | | | | | |
|---|---|---|---|---|---|
| 5,054,702 | A | * | 10/1991 | Heinemann | 241/230 |
| 5,269,477 | A | | 12/1993 | Buchholtz et al. | |
| 5,273,512 | A | * | 12/1993 | Ducasse | 492/36 |
| 5,601,520 | A | * | 2/1997 | Wollner et al. | 492/33 |
| 5,660,092 | A | * | 8/1997 | Scholz et al. | 82/1.11 |
| 5,704,561 | A | * | 1/1998 | Ansen et al. | 241/293 |
| 5,954,282 | A | * | 9/1999 | Britzke et al. | 241/275 |
| 6,786,630 | B2 | * | 9/2004 | Haberer | 366/79 |
| 7,008,123 | B2 | * | 3/2006 | Camp et al. | 396/583 |
| 7,497,396 | B2 | * | 3/2009 | Splinter et al. | 241/294 |
| 7,510,135 | B2 | * | 3/2009 | Burchardt et al. | 241/294 |
| 7,669,331 | B2 | * | 3/2010 | Sohl et al. | 29/895.2 |
| 7,946,518 | B2 | * | 5/2011 | Patzelt et al. | 241/293 |
| 2004/0244455 | A1 | * | 12/2004 | Eschner | 72/236 |

FOREIGN PATENT DOCUMENTS

| | | | | |
|---|---|---|---|---|
| DE | 19618143 | A1 | * | 11/1997 |
| DE | 19618143 | A1 | | 11/1997 |
| EP | 0516952 | A1 | | 12/1992 |
| JP | 04284858 | A | * | 10/1992 |
| WO | WO 8700105 | A1 | * | 1/1987 |

* cited by examiner

METHOD FOR RECONDITIONING A USED GRINDING ROLLER

FIELD OF THE INVENTION

The invention relates to a method for reconditioning a used grinding roller of a high-pressure material bed roller mill in accordance with the preamble of claim 1.

BACKGROUND OF THE INVENTION

Grinding rollers of this type are known, for example, from EP 0 516 952 B1. They contain a plurality of wear-resistant profile-members which are embedded, with a portion of the length thereof, in holes of the roller body and, with the remainder of the length thereof, project above the surface of the roller body. When such rollers are operated, the intermediate spaces between the projecting profile-members are filled with the material to be comminuted which is supplied to the material bed roller mill and which therefore produces a given autogenous wear protection for the surface of the roller body.

Both the projecting profile-members and the surface of the roller body are subjected, in the course of the operating time, to unavoidable wear which makes reconditioning of the grinding roller necessary if the roller body is intended to be further used.

DE 196 18 143 A1 discloses a grinding roller, in which the hardness of the material of the roller body forming the roller surface is greater than 56 HRc (Rockwell hardness). That grinding roller is used in comminution operation until a substantial portion of all the profile-members is completely worn and/or has fallen out of the roller body. The reconditioning of the used grinding roller is then carried out in such a manner that the roller surface has its cylindrical shape conferred on it again by the profile-members and the original holes being completely turned, after which new holes are produced and new profile-members are introduced into those holes.

SUMMARY OF THE INVENTION

Although it is possible, by using an extraordinarily hard base material for the surface of the roller body, for that surface to wear substantially only to the same extent as the projecting profile-members, the complete turning of the surface of the roller body provided with holes involves substantial complexity owing to the great hardness of the surface material when a used grinding roller of this type is reconditioned.

Therefore, the problem addressed by the invention is to configure a method in accordance with the preamble of claim 1 in such a manner that cost-effective reconditioning of a used grinding roller is possible.

This problem is solved according to the invention by the characterising features of claim 1. The subsidiary claims relate to advantageous constructions of the invention.

In the method according to the invention, the worn surface of the roller body is turned at least in a part-region of the width of the roller body when a specific wear state is reached. Subsequently, a material layer is applied at least to the turned surface in a welding operation in order to increase the diameter.

In another operating step, the welded material layer is subsequently provided with holes for receiving new profile-members. In accordance with the thickness of the welded material layer and the desired anchoring depth of the new profile-members, those holes can either be provided only in the welded material layer or extend as far as a location in the base material of the roller body under that material layer.

The advantageous selection of the part-regions to be turned, the selection of the turning depth and the thickness of the material layers which are welded in the individual part-regions particularly depend on the respective wear situation.

For instance, it may be advantageous for less heavily worn part-regions to be turned as far as the diameter of the most heavily worn part-region and then for a common material layer to be applied to those differently worn part-regions.

Instead, however, it is also possible to turn differently worn part-regions in different manners and, subsequently, to weld material layers of different thicknesses to the surface of those part-regions in order to obtain a uniform outer diameter.

Finally, it may also be advantageous in a corresponding wear situation for only the most heavily worn part-region to be turned and for a material layer to be welded only to that turned part-region.

Owing to the operations according to the invention, therefore, the worn surface of a roller body can also be levelled again with varying degrees of wear of the individual part-regions with the smallest possible complexity in terms of material and work. The method according to the invention is consequently distinguished by a time-saving, material-saving and cost-effective reconditioning of a used grinding roller.

DETAILED DESCRIPTION OF THE INVENTION

Figure 1:
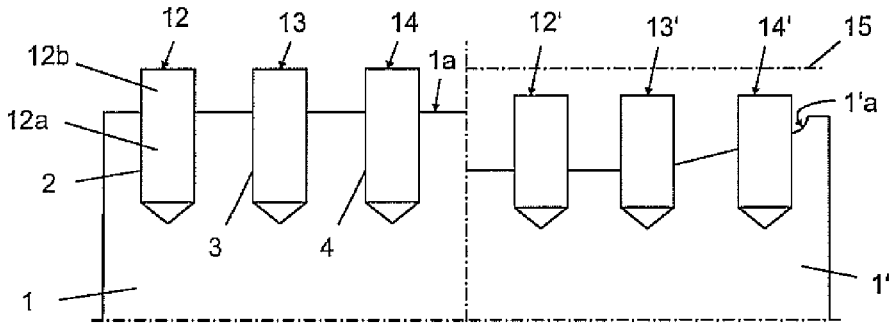
FIG. 1 is a schematic longitudinal part-section of a roller in a new state (see left-hand side) versus a worn state (see right-hand side)

A number of embodiments of the invention are illustrated in the drawings.

FIG. 1 is a schematic longitudinal part-section of the roller and shows, on the left, the new state of the roller. The roller body 1 is provided with a plurality of holes 2, 3, 4, in which profile-members 12, 13, 14 are each embedded with a portion of the length thereof (for example, 12*a*), whereas they project with the remainder of the length thereof (for example, 12*b*) above the surface 1*a* of the roller body 1.

FIG. 1 shows, on the right, the worn state after a given operating time. The surface 1*a* of the roller body 1' is now removed to a greater or lesser extent and differently in the individual regions. Similarly, the profile-members 12', 13', 14' are now shortened owing to the wear with respect to the original length (height line 15).

Figure 2:
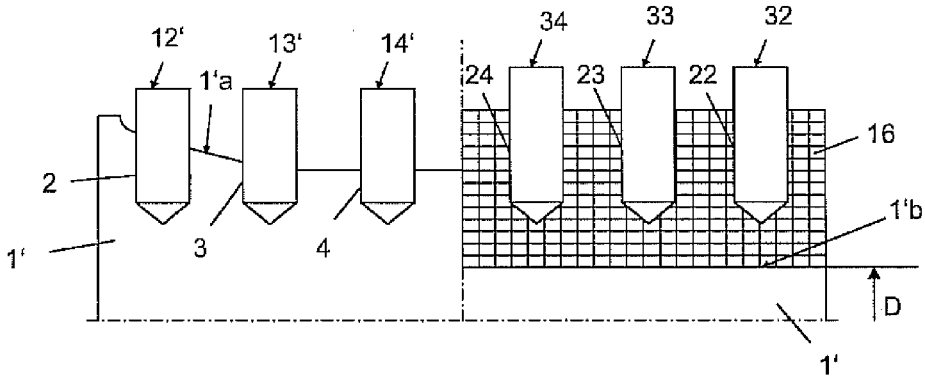
FIG. 2 is a schematic illustration of a reconditioned grinding roller according to an embodiment of the present invention.

FIG. 2 illustrates how a used grinding roller can be reconditioned in accordance with a first variant of the method according to the invention. On the left, the worn state of the roller body 1' and the profile-members 12', 13', 14' already described with reference to FIG. 1 is illustrated. For the reconditioning operation, the worn profile-members 12', 13', 14' are first removed.

Subsequently, the worn surface 1'*a* of the roller body 1' is turned as far as a diameter D. The diameter D is, in this embodiment, smaller than the diameter of the base of the holes 2, 3, 4. Those old holes are consequently completely removed by the turning operation.

Subsequently, a material layer 16 is applied to the turned surface 1'*b* of the roller body 1 in a welding operation in order to increase the diameter. That material layer 16 is then provided with holes 22, 23, 24 in order to receive new profile-members 32, 33, 34.

In the additional embodiment illustrated in FIG. 3, the worn state is again illustrated on the left and the state after the reconditioning is illustrated on the right. In this instance, the surface 1'*a* of the roller body 1' that is worn to different degrees was, after all the profile-members 12', 13', 14' were removed, turned in the peripheral regions of the width of the roller body (that is to say, in this instance, in the regions in which the profile-members 12', 13' were located) as far as the diameter D' of the most heavily worn part-region (that is to say in this instance, in the region of the profile-members 14').

A plurality of coatings of a material layer 26 are subsequently applied in a welding operation to the substantially levelled surface 1'*c* which is produced in this manner. Subsequently, that material layer 26 is provided with holes 22, 23, 24, in which new profile-members 32, 33, 34 are introduced.

Figure 3:
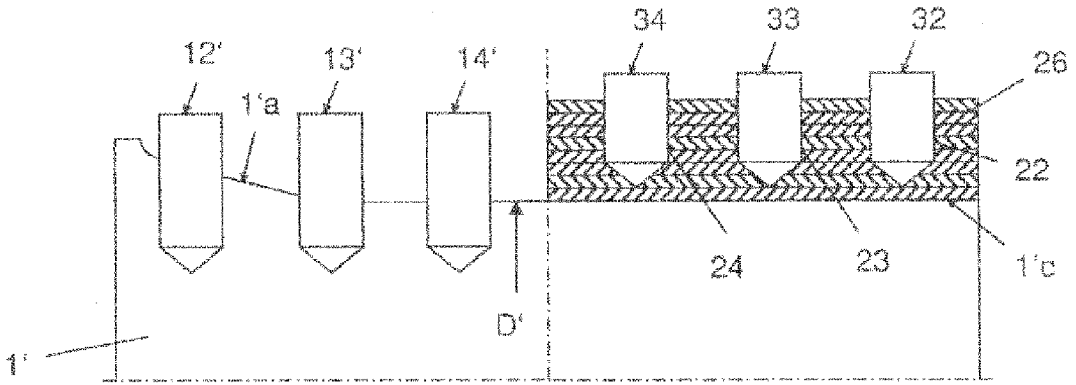
FIG. 3 is a schematic illustration of a reconditioned grinding roller according to another embodiment of the present invention.
Figure 4:
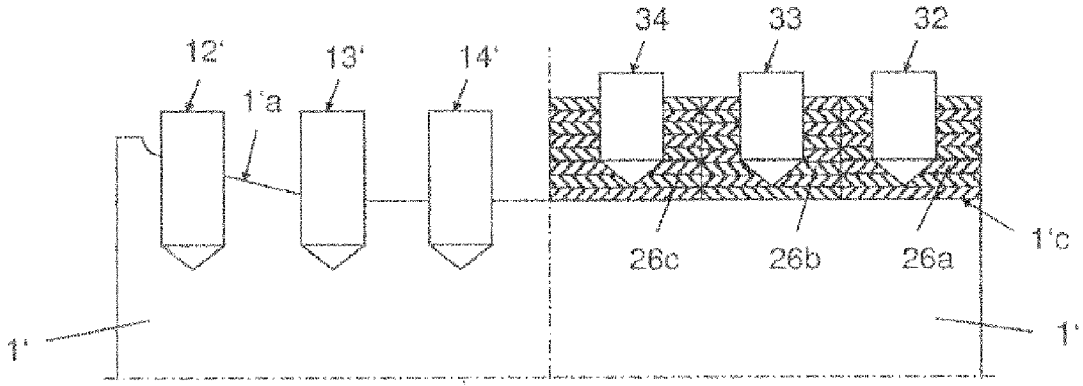
FIG. 4 is a schematic illustration of a reconditioned grinding roller according to another embodiment of the present invention.

FIG. 4 illustrates a development of the variant according to FIG. 3. In this instance, material layers 26*a*, 26*b*, 26*c* (each in a plurality of coatings) are applied to the levelled surface 1'*c* of the roller body 1' and can have—when viewed over the width of the roller body 1'—different hardnesses, thicknesses and wear properties. As a result, consideration can be taken in particular of the various wear stresses which occur during operation in the individual part-regions of the width of the roller body.

Figure 5:
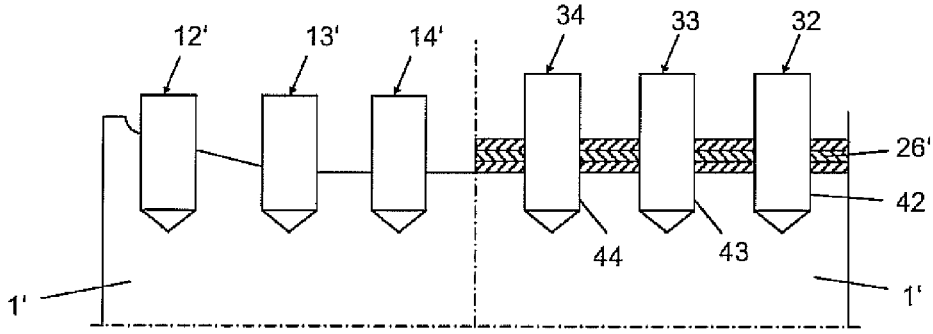
FIG. 5 is a schematic illustration of a reconditioned grinding roller according to another embodiment of the present invention.

Whereas, in the embodiments explained with reference to FIGS. 2 to 4, the holes 22, 23, 24 for receiving the new profile-members 32, 33, 34 are provided exclusively in the welded material layer 16 or 26 or 26*a*, 26*b*, 26*c*, FIG. 5 shows a variant of the construction according to FIG. 4, wherein the holes 42, 43, 44 for receiving the new profile-members 32, 33, 34 are constructed through the welded material layer 26' and extend into the base material of the roller body 1' under that material layer 26'. In that instance, the thickness of the welded material layer 26' can be kept substantially smaller than in the variant according to FIG. 3.

Figure 6:
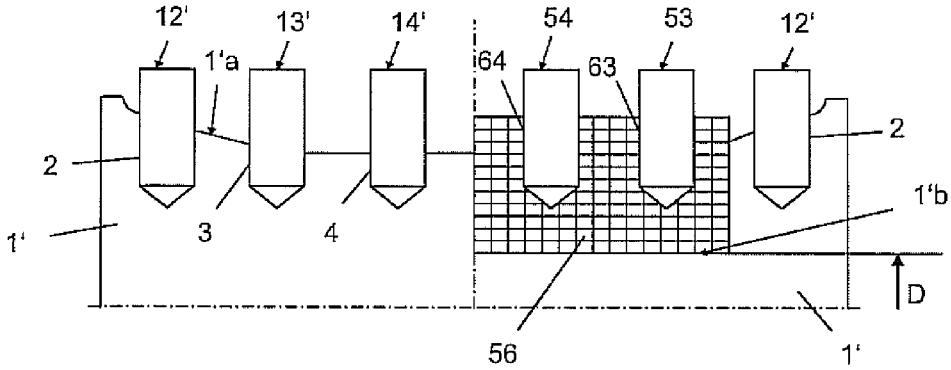
FIG. 6 is a schematic illustration of a reconditioned grinding roller according to another embodiment of the present invention.

In the variant (illustrated in FIG. 6) of the construction according to FIG. 2, only the most heavily worn, inner part-region of the width of the roller body 1' has been turned, in which region the profile-members 13', 14' were located. A material layer 56 was applied to that turned part-region in a welding operation. Holes 63, 64 in that material layer 56 receive the new profile-members 53, 54 whose length is selected in such a manner that the upper edges thereof are substantially at the height of the upper edge of the non-removed profile-members 12' in the peripheral region of the width of the roller body that is worn only slightly.

There applies to the method according to the invention the principle that the roller body does not in each case have to have a uniform diameter over the entire length of the roller body after the reconditioning operation. Instead, different diameters can be selected for individual part-regions, for instance, if the peripheral region is worn only to a small degree and therefore no welding is carried out at that location.

The invention claimed is:

1. Method for reconditioning a used grinding roller of a material bed roller mill, containing a plurality of profile-members which are embedded, with a portion of the length thereof, in holes of the roller body and, with the remainder of the length thereof, projecting above the surface of the roller body, with that projecting portion of the profile-members and the surface of the roller body being at least partially worn, characterised by the following method steps:

a) after the worn profile-members are removed, the worn surface of the roller body is turned at least in a part-region of the width of the roller body and differently worn part-regions are turned to different diameters;

b) subsequently, material layers of different thicknesses are applied to the surface of those part-regions in a welding operation in order to obtain a uniform outer diameter; and c) subsequently, the welded material layers are provided with holes for receiving new profile-member.

2. Method according to claim 1, characterised in that the material layer which is applied in a welding operation—when viewed over the width of the roller body—has different hardnesses, thicknesses and wear properties.

3. Method according to claim 1, characterised in that the holes which are constructed in the welded material layer extend into the base material of the roller body located under that material layer.

4. Method for reconditioning a used grinding roller of a material bed roller mill, containing a plurality of profile-members which are embedded, with a portion of the length thereof, in holes of the roller body and, with the remainder of the length thereof, projecting above the surface of the roller body, with that projecting portion of the profile-members and the surface of the roller body being at least partially worn, characterised by the following method steps:

a) after the worn profile-members are removed, only a most heavily worn part-region of the worn surface of the roller body is turned to a diameter along the width of the roller body;

b) subsequently, a material layer is applied at least to the turned surface in a welding operation in order to increase the diameter; and c) subsequently, that welded material layer is provided with holes for receiving new profile-members.

5. Method according to claim 4, characterised in that the material layer which is applied in a welding operation—when viewed over the width of the roller body—has different hardnesses, thicknesses and wear properties.

6. Method according to claim 4, characterised in that the holes which are constructed in the welded material layer extend into the base material of the roller body located under that material layer.

7. Method for reconditioning a used grinding roller of a material bed roller mill, containing a plurality of profile-members which are embedded, with a portion of the length thereof, in holes of the roller body and, with the remainder of the length thereof, projecting above the surface of the roller body, with that projecting portion of the profile-members and the surface of the roller body being at least partially worn, characterised by the following method steps:

a) after the worn profile-members are removed, the worn surface of the roller body is turned to a diameter at least in a part-region of the width of the roller body;

b) subsequently, a material layer is applied at least to the turned surface in a welding operation in order to increase the diameter and when viewed over the width of the roller body has different hardnesses, thicknesses and wear properties; and c) subsequently, that welded material layer is provided with holes for receiving new profile-members.

8. Method according to claim 7, characterised in that a) less heavily worn part-regions are turned as far as the diameter of the most heavily worn part-region and b) subsequently, a common material layer is applied to those differently worn part-regions in a welding operation in order to increase the diameter.

9. Method according to claim 7, characterised in that a) differently worn part-regions are turned to different diameters and b) subsequently, material layers of different thicknesses are applied to the surface of those part-regions in a welding operation in order to obtain a uniform outer diameter.

10. Method according to claim 7, characterised in that a) only the most heavily worn part-region is turned and b) subsequently, a material layer is applied to that turned part-region in a welding operation.

11. Method according to claim 7, characterised in that the holes which are constructed in the welded material layer extend into the base material of the roller body located under that material layer.

* * * * *